US007152251B2

(12) United States Patent
Yan

(10) Patent No.: US 7,152,251 B2
(45) Date of Patent: Dec. 26, 2006

(54) FOLDABLE BILL CAP

(76) Inventor: Suen Ching Yan, 17145 Margay Ave., Carson, CA (US) 90746

( * ) Notice: Subject to any disclaimer, the term of this patent is extended or adjusted under 35 U.S.C. 154(b) by 0 days.

(21) Appl. No.: 11/044,529

(22) Filed: Jan. 26, 2005

(65) Prior Publication Data

US 2006/0162047 A1 Jul. 27, 2006

(51) Int. Cl.
*A42B 1/20* (2006.01)

(52) U.S. Cl. ..... 2/195.6; 2/12; 2/175.5

(58) Field of Classification Search ..... 2/195.6, 2/171.03, 209.3, 195.7, 12, 175.5
See application file for complete search history.

(56) References Cited

U.S. PATENT DOCUMENTS

| | | | | |
|---|---|---|---|---|
| 4,549,316 | A * | 10/1985 | Johnson | 2/195.1 |
| D289,700 | S | 5/1987 | Burns | D2/244 |
| 4,694,506 | A | 9/1987 | Perna | 2/12 |
| 5,450,629 | A | 9/1995 | Gilstrap | 2/209.11 |
| 5,845,339 | A | 12/1998 | Ashley et al. | 2/195.6 |
| 6,357,051 | B1 | 3/2002 | Lee | 2/195.1 |
| 6,408,443 | B1 | 6/2002 | Park | 2/195.1 |
| 6,721,961 | B1 | 4/2004 | Park | 2/175.5 |
| 6,735,782 | B1 * | 5/2004 | Park | 2/175.5 |

FOREIGN PATENT DOCUMENTS

| | | |
|---|---|---|
| WO | WO97/22270 | 12/1995 |

* cited by examiner

*Primary Examiner*—Gary L. Welch
*Assistant Examiner*—Sally Colson Cline
(74) *Attorney, Agent, or Firm*—Cislo & Thomas, LLP

(57) ABSTRACT

A headwear piece or cap comprises a crown portion and a bill portion conjoined at one end with the crown portion. The bill portion includes a stiffening insert configured to fold in at least one location by way of an interior slot and adjoining terminal crease sections. Each terminal crease section is formed by the provision of oppositely disposed upper and lower indentations at each end of the interior slot. The foldable stiffening insert is sandwiched between two flexible layers.

19 Claims, 2 Drawing Sheets

FOLDABLE BILL CAP

BACKGROUND

Headwear, such as a baseball cap, is generally not suitable for storing in a pocket, or otherwise, because of the stiffness of the bill portion of the cap. Typically, the user packs the flexible crown portion of the cap in his/her pocket, leaving the relatively rigid bill portion hanging out to avoid damage to the same. Alternatively, stuffing the bill portion in a pocket leaves the crown portion hanging out. Walking around with a bill or crown portion hanging out of a pants pocket is not only awkward, but also quite uncomfortable.

Various baseball cap configuration attempts at solving the rigid bill problem are known. Commonly, such bill configurations include a two-piece stiffening insert and a centrally located pre-formed fold line. Unfortunately, bill portions that incorporate two-piece stiffening inserts do not maintain their intended original shapes well after being worn by the user for a period of time. Consequently, such bill portions become unpleasing to the eye and uncomfortable to wear, not to mention their complex construction and attendant economical costs.

SUMMARY

Exemplary embodiments disclosed herein are generally directed to foldable headwear or cap.

In accordance with one aspect of the invention, the headwear piece comprises a crown portion and a bill portion conjoined with the crown portion. The bill portion includes a stiffening insert configured to fold in at least one location by way of an interior slot and adjoining terminal crease sections.

In accordance with another aspect of the invention, the cap comprises a crown portion and a foldable bill portion conjoined with the crown portion. The foldable bill portion includes an integral stiffening insert having an intermediate slot between first and second ends thereof and adjoining terminal crease sections. The integral stiffening insert is sandwiched between two flexible layers and configured to fold in at least one location by way of the intermediate slot and the adjoining terminal crease sections.

These and other aspects of the invention will become apparent from a review of the accompanying drawings and the following detailed description of the invention.

BRIEF DESCRIPTION OF THE DRAWINGS

The invention is generally shown by way of reference to the accompanying drawings in which.

DETAILED DESCRIPTION

The detailed description set forth below in connection with the appended drawings is intended as a description of exemplary embodiments and is not intended to represent the only forms in which the exemplary embodiments may be constructed and/or utilized. The description sets forth the functions and the sequence of steps for constructing and operating the exemplary embodiments in connection with the illustrated embodiments. However, it is to be understood that the same or equivalent functions and sequences may be accomplished by different embodiments that are also intended to be encompassed within the spirit and scope of the present invention.

Some embodiments of the invention will be described in detail with reference to the related drawings of FIGS. 1–5. Additional embodiments, features and/or advantages of the invention will become apparent from the ensuing description or may be learned by practicing the invention. In the figures, the drawings are not to scale with like numerals referring to like features throughout both the drawings and the description.

Figure 1:
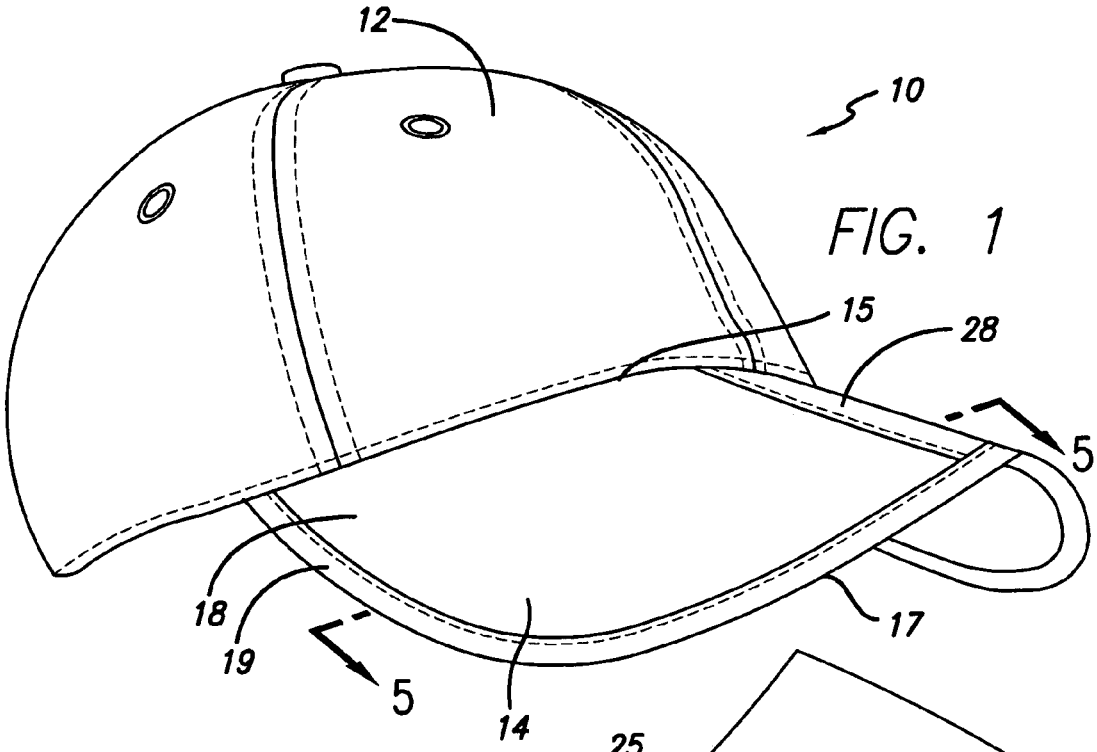
FIG. 1 is a side perspective view of a headwear piece or cap in accordance with an exemplary embodiment of the present invention.
Figure 2:
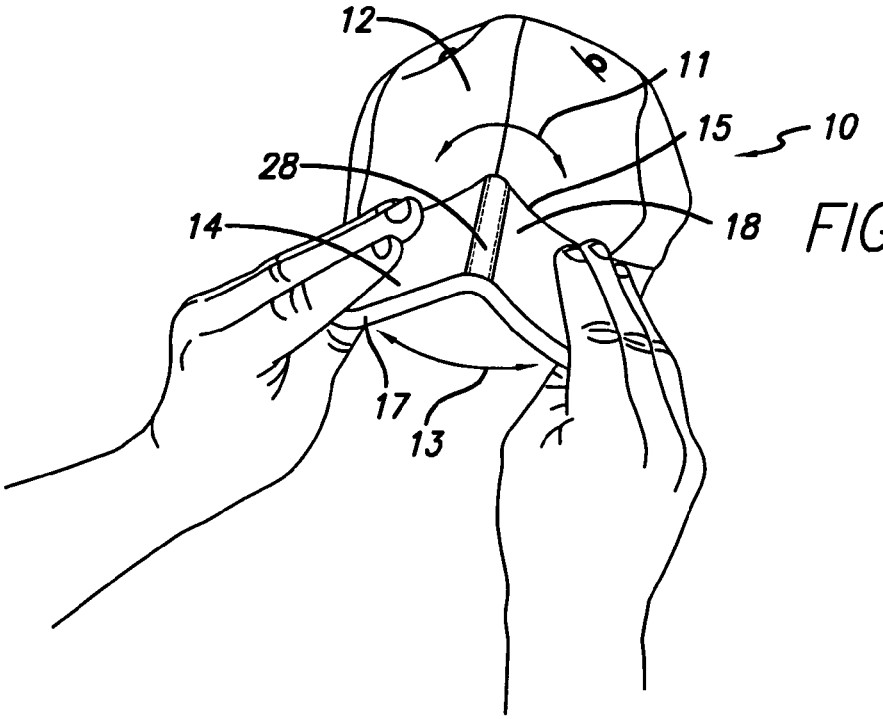
FIG. 2 is a front perspective view of the headwear piece or cap of FIG. 1 being used in accordance with an exemplary embodiment of the present invention.
Figure 3:
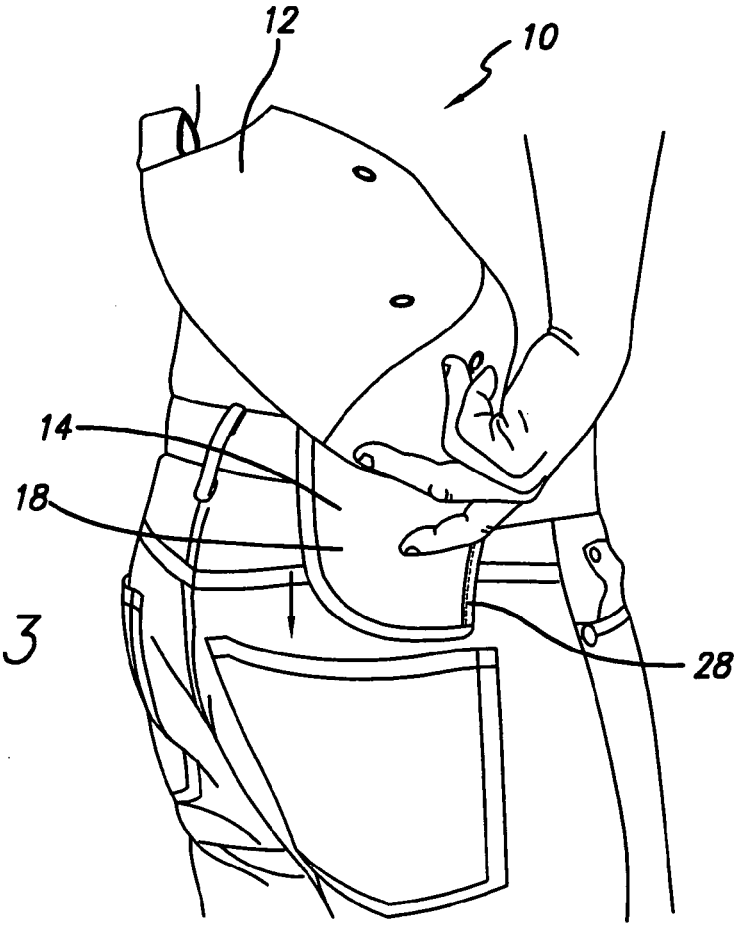
FIG. 3 is a side perspective view of the headwear piece or cap of FIG. 1 being used in accordance with another exemplary embodiment of the present invention.

FIG. 1 is a side perspective view of a headwear piece or cap 10 in accordance with an exemplary embodiment of the present invention. Headwear piece or cap 10 includes a crown portion 12 and a foldable bill portion 14 conjoined with crown portion 12 at a back end 15 (FIGS. 1–2). Crown portion 12 is configured to provide a partial close-fitting head covering. Crown portion 12 may be made from a plurality of fabric sections sewn together to form a partial covering for the forehead, temples, and upper head portion of the user, as generally shown in FIGS. 1–2. Alternatively, crown portion 12 may be made from an appropriately configured contiguous piece of flexible material. In each case, the flexible material is suitable for application and display of commercial and/or personal insignia such as logos, advertising and/or the like. Insignia may be applied by various means such as, for example, embroidering, stamping, painting, screen-printing and/or the like.

Bill portion 14 is configured to shade and protect the eyes of a user from the elements. Bill portion 14 may be folded substantially in the middle, as generally indicated by directional arrow 11 (FIG. 2), for convenient storage of headwear piece 10 in a user's pants pocket (FIG. 3) or the like. Bill portion 14 may be unfolded, as generally indicated by directional arrow 13 (FIG. 2), if the user wishes to wear headwear piece 10. Once unfolded, bill portion 14 generally maintains its shape while headwear piece 10 is being worn by the user.

Figure 4:
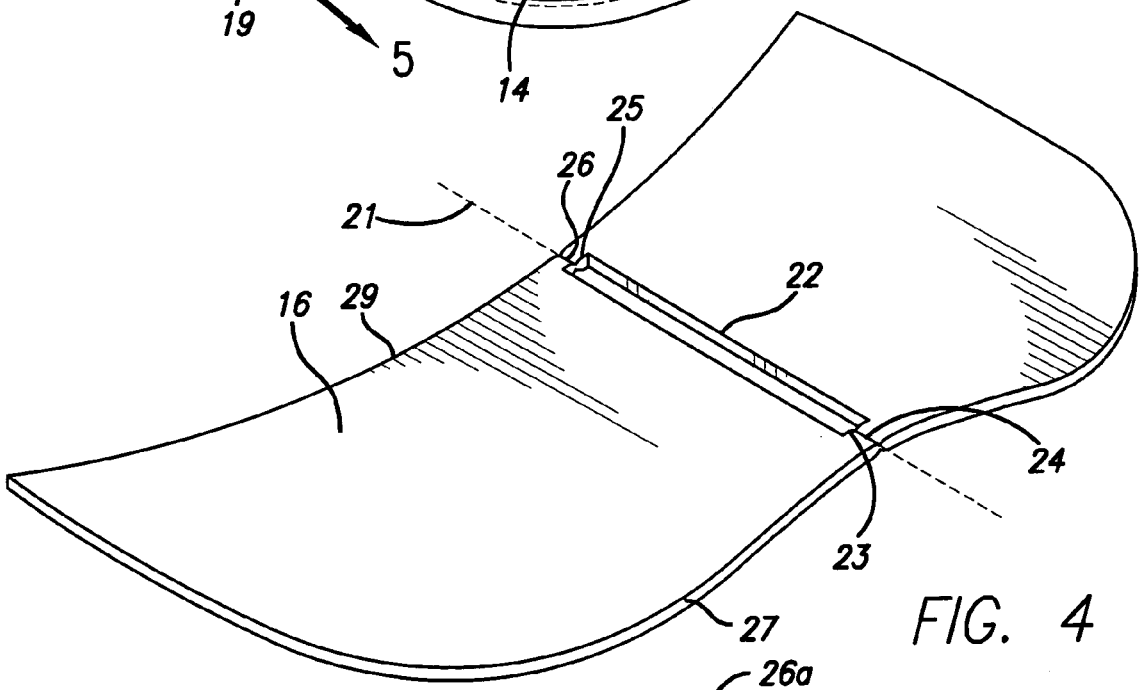
FIG. 4 is a top perspective view of a foldable one-piece bill insert of the headwear piece or cap of FIG. 1.
Figure 5:
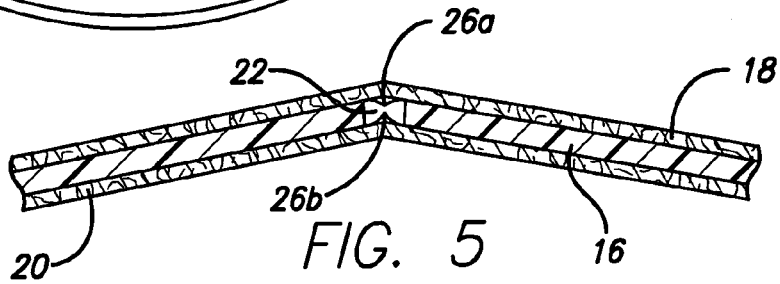
FIG. 5 is a cross-sectional view of a bill portion taken along section line 5—5 of FIG. 1.

As generally depicted in FIGS. 4–5, bill portion 14 includes an integral, one-piece foldable stiffening insert 16 that is sandwiched between appropriately configured top and bottom flexible layers 18 and 20, respectively. Top and bottom layers 18, 20 may be made from fabric, leather or other suitable material. Top and bottom layers 18, 20 may be adapted for application and display of commercial and/or personal insignia such as logos, advertising and/or the like. Stiffening insert 16 may be made from plastic, cardboard or other suitable material.

Stiffening insert 16 is configured to fold substantially in the middle via a centrally disposed interior (intermediate) slot 22 and adjoining terminal crease sections 24 and 26, as generally illustrated in FIG. 4. Each terminal crease section is formed by the provision of generally oppositely disposed upper and lower indentations, such as indentations 26*a* and 26*b* (FIG. 5), at each end of interior slot 22. Crease section 24 abuts a front end 23 of interior slot 22 (FIG. 4). Crease section 26 abuts a back end 25 of interior slot 22 (FIG. 4). In accordance with an exemplary embodiment of the present invention, terminal crease sections 24 and 26 may be disposed along a longitudinal axis 21 (FIG. 4) of interior slot 22. Other suitable crease section configurations may be utilized, if needed.

The material used to make stiffening insert 16 is picked from a range of materials, such as plastic, cardboard and the like, that are suitable for forming relatively long lasting terminal crease sections at each end of an interior slot, as generally shown in FIGS. 4–5. A reinforcement strip 28 may be affixed to the portion of top flexible layer 18 that is disposed over slot 22 and crease sections 24 and 26, as generally illustrated in FIG. 1. Reinforcement strip 28 may be made from fabric or other suitable material. When made from fabric, reinforcement strip 28 may be stitched at each side to top flexible layer 18, as generally shown in FIG. 2. Moreover, a reinforcement strip 19 may be provided over a front end (brim) 17 of bill portion 14, as generally depicted in FIG. 1.

Intermediate slot 22 may be formed between first and second ends 27, 29, respectively, of stiffening insert 16, as generally shown in FIG. 4. A variety of dimensions and materials may be utilized to form intermediate slot 22. For example, a generally rectangular intermediate slot that is about 2 inches long and about 0.13 inches wide may be formed in a plastic stiffening insert that is about 0.063 inches thick during molding of the same. The plastic stiffening insert may be molded in a crescent-like shape or other suitable shape, as needed. A terminal crease section may be formed at each end of the intermediate slot by repeatedly folding/unfolding the molded stiffening insert generally along the longitudinal axis of the intermediate slot.

The plastic material used to mold the stiffening insert of the present invention would be of such grade and quality that is suitable for forming the terminal crease sections, i.e. the molded plastic insert will not rupture during folding/unfolding. The pre-creased stiffening insert may be clad, for example, in a durable fabric that is about 0.031 inches thick. Other suitable flexible materials may be utilized, as needed. The fabric-clad stiffening insert may be affixed at its back end to the crown portion of a cap. The crown portion may be made from fabric or other suitable material, as needed. The affixed fabric-clad stiffening insert forms the bill portion of the cap. Reinforcement strips of fabric or other suitable material may be affixed to the bill portion of the cap, as described hereinabove. For example, a double stitched durable fabric strip of about 0.016 inch thickness may be used.

A person skilled in the art would readily appreciate that the one-piece integral stiffening insert of the present invention allows the foldable bill portion to maintain its shape relatively well when worn by the user. The terminal crease sections of the present invention act generally like living hinges.

A person skilled in the art would also appreciate that the exemplary embodiments described hereinabove are merely illustrative of the general principles of the present invention. For example, the stiffening insert of the present invention may be provided, if needed, with more than one interior slot and corresponding terminal crease sections. Moreover, the interior slot of the present invention may be formed at other than an intermediate location. Other modifications or variations may be employed that reside within the scope of the invention. Thus, by way of example, but not of limitation, alternative configurations may be utilized in accordance with the teachings herein. Accordingly, the drawings and description are illustrative and not meant to be a limitation thereof.

Moreover, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Thus, it is intended that the invention cover all embodiments and variations thereof as long as such embodiments and variations come within the scope of the appended claims and their equivalents.

What is claimed is:

1. A headwear piece, comprising:

a crown portion;

a bill portion conjoined with said crown portion at a first end, said bill portion including a brim at a second end;

a stiffener inserted within said bill portion between said first and second ends;

a rectangular slot formed within the interior of said inserted stiffener substantially midway between said first and second ends of said bill portion, said interior rectangular slot having a front end, a rear end and a longitudinal axis;

a first crease section integrally formed on said inserted stiffener between said front end of said rectangular slot and said second end of said bill portion along said longitudinal axis; and a second crease section integrally formed on said inserted stiffener between said rear end of said rectangular slot and said first end of said bill portion along said longitudinal axis, said bill portion configured to fold along said longitudinal axis via said interior rectangular slot and said first and second crease sections.

2. The headwear piece of claim 1, wherein each of said first and second crease sections is formed by the provision of integral oppositely disposed upper and lower indentations on said stiffener.

3. The headwear piece of claim 2, wherein said bill portion further includes two flexible layers.

4. The headwear piece of claim 3, wherein said foldable stiffener is sandwiched between said two flexible layers.

5. The headwear piece of claim 4, wherein at least one of said flexible layers is adapted for application and display of insignia.

6. The headwear piece of claim 4, further comprising at least one reinforcement strip being affixed to a portion of one of said flexible layers, said affixed reinforcement strip being disposed over said interior rectangular slot and said first and second crease sections.

7. The headwear piece of claim 6, wherein said at least one reinforcement strip is made from fabric.

8. The headwear piece of claim 7, wherein said bill portion folds substantially midway to facilitate storage.

9. The headwear piece of claim 8, wherein said bill portion substantially maintains its overall shape when unfolded from a stored state.

10. The headwear piece of claim 4, wherein at least one of said flexible layers is made from fabric.

11. The headwear piece of claim 10, wherein said foldable stiffener is made from plastic.

12. The headwear piece of claim 11, wherein said crown portion is made from flexible material.

13. The headwear piece of claim 12, wherein said flexible material is adapted for application and display of insignia.

14. The headwear piece of claim 1, wherein said crown portion is made from a plurality of fabric sections sewn together to form a partial covering for the head of a user.

15. The headwear piece of claim 1, wherein said foldable stiffener is made from cardboard.

16. The headwear piece of claim 1, wherein said foldable stiffener is made from material suitable for forming long lasting crease sections.

17. The headwear piece of claim 1, wherein said foldable stiffener is substantially crescent-shaped.

18. A headwear piece, comprising:

a crown portion;

a bill portion conjoined with said crown portion at a first end, said bill portion including a brim at a second end and top and bottom flexible layers;

a stiffener inserted within said bill portion between said first and second ends, said inserted stiffener being sandwiched between said top and bottom flexible layers;

a rectangular slot formed within the interior of said inserted stiffener substantially midway between said first and second ends of said bill portion, said interior rectangular slot having a front end, a rear end and a longitudinal axis;

a first crease section integrally formed on said inserted stiffener between said front end of said rectangular slot and said second end of said bill portion along said longitudinal axis, said first crease section functioning substantially as a living hinge; and a second crease section integrally formed on said inserted stiffener between said rear end of said rectangular slot and said first end of said bill portion along said longitudinal axis, said second crease section functioning substantially as a living hinge, each of said first and second crease sections being formed by the provision of integral oppositely disposed upper and lower indentations on said stiffener, wherein said bill portion is configured to fold along said longitudinal axis via said interior rectangular slot and said first and second crease sections.

19. A headwear piece, comprising:

a crown portion;

a bill portion conjoined with said crown portion at a first end, said bill portion including a brim at a second end and top and bottom flexible layers;

a stiffener inserted within said bill portion between said first and second ends, said inserted stiffener being sandwiched between said top and bottom flexible layers;

a rectangular slot formed within the interior of said inserted stiffener substantially midway between said first and second ends of said bill portion, said interior rectangular slot having a front end, a rear end and a longitudinal axis;

a first crease section integrally formed on said inserted stiffener between said front end of said rectangular slot and said second end of said bill portion along said longitudinal axis, said first crease section functioning substantially as a living hinge; and a second crease section integrally formed on said inserted stiffener between said rear end of said rectangular slot and said first end of said bill portion along said longitudinal axis, said second crease section functioning substantially as a living hinge, each of said first and second crease sections being formed by the provision of integral oppositely disposed upper and lower indentations on said stiffener, said oppositely disposed upper and lower indentations having substantially an hourglass cross-section, said bill portion being configured to fold along said longitudinal axis via said interior rectangular slot and said first and second crease sections.

* * * * *